United States Patent [19]

Yoshino

[11] Patent Number: 4,871,160

[45] Date of Patent: Oct. 3, 1989

[54] SHEET FEEDING APPARATUS

[75] Inventor: Shigeru Yoshino, Kanagawa, Japan

[73] Assignee: Fuji Photo Film Co., Ltd., Kanagawa, Japan

[21] Appl. No.: 167,286

[22] Filed: Mar. 11, 1988

[30] Foreign Application Priority Data

Mar. 20, 1987 [JP] Japan ..... 62-64291

[51] Int. Cl.[4] ..... B65H 3/44; B65H 5/26; B65H 3/06

[52] U.S. Cl. ..... 271/9; 271/110; 271/119; 271/257

[58] Field of Search ..... 271/9, 110, 119, 257, 271/258

[56] References Cited

U.S. PATENT DOCUMENTS

| | | | |
|---|---|---|---|
| 4,204,668 | 5/1980 | Yanagawa | 271/9 |
| 4,337,935 | 7/1982 | Sawada et al. | 271/9 |
| 4,429,863 | 2/1984 | Itoh et al. | 271/9 |
| 4,483,528 | 11/1984 | Takeyama et al. | 271/127 X |
| 4,597,328 | 4/1986 | Hagihara et al. | 271/9 |
| 4,790,524 | 12/1988 | Murakami et al. | 271/9 |

FOREIGN PATENT DOCUMENTS

| | | | |
|---|---|---|---|
| 2361621 | 7/1974 | Fed. Rep. of Germany | 271/9 |
| 3608273 | 9/1987 | Fed. Rep. of Germany | 271/9 |
| 3707868 | 9/1987 | Fed. Rep. of Germany | 271/9 |
| 61239 | 5/1981 | Japan | 271/9 |
| 6540 | 1/1985 | Japan | 271/9 |
| 262743 | 12/1985 | Japan | 271/9 |

*Primary Examiner*—Kevin P. Shaver
*Assistant Examiner*—Steven M. Reiss
*Attorney, Agent, or Firm*—Sughrue, Mion, Zinn, Macpeak & Seas

[57] ABSTRACT

A sheet feeding apparatus for use in a photocopier or the like in which sheets can be fed automatically from a cassette or manually from a manual-insertion tray to a pair of conveying rollers without interference and using a simple structure. Sheets are fed from the cassette to the conveying rollers with a semicircular roller, the latter having a flat surface which is directed downward at the completion of each sheet feeding operation. The manual insertion tray guides the manually inserted sheets along a path below the semicircular roller. A sensor detects when a sheet has been manually inserted, in which case rotation of the semicircular roller is inhibited.

3 Claims, 2 Drawing Sheets

SHEET FEEDING APPARATUS

BACKGROUND OF THE INVENTION

The present invention generally relates to a sheet feeding apparatus. More particularly, the invention relates to a sheet feeding apparatus for feeding a sheet from a sheet-accommodating cassette or a manually inserted sheet to a picture-forming (picture transfer) position.

Various apparatuses for forming a picture on a sheet material are known, including a picture recording apparatus in which a picture from a photosensitive material is transferred to a picture-receiving sheet. In this apparatus, for example, picture-receiving sheets are accommodated in a cassette and fed one by one to a picture transfer section. In order to feed a sheet accommodated in the cassette to the picture transfer section, for example, a semicircular roller is provided above the cassette. When the semicircular roller is rotated, the outer circumferential arcuate surface of the rollers abut the uppermost one of the sheets contained within the cassette to thereby draw out the uppermost sheet from the cassette by the frictional force acting between the semicircular roller and the sheet. The thus drawn-out sheet is then conveyed to the picture transfer section by conveying rollers.

Also, a manual-insertion sheet feeding apparatus is known in which a sheet material is manually fed by the operator. In such a manual-insertion sheet-feeding apparatus, the operator inserts a sheet into an insertion opening, and the sheet is guided along a guide member to conveying rollers.

A picture recording apparatus as described above has been proposed incorporating separately an automatic sheet-feeding apparatus and a manual-insertion sheet-feeding apparatus. In such a case, however, there is a problem in that the picture recording apparatus is large in size. Accordingly, a picture-receiving sheet feeding apparatus in which an automatic sheet-feeding function and a manual-insertion sheet-feeding function are integrally provided has been developed. A sheet feeding apparatus of this type is provided with, for example, a semicircular roller disposed above a cassette for accommodating sheets, a guide member for guiding a manually inserted sheet to a position below the semicircular roller, and a cover for closing the top operation of the cassette when a sheet is manually feed. When a sheet is automatically fed, the cover is moved to open the cassette so that the sheet in the cassette faces the semicircular roller so as to be fed by the semicircular roller, while when a sheet is to be fed manually, the cover is moved so as to close the cassette so that no sheet faces the semicircular roller, and a sheet is manually inserted at a position below the semicircular roller along the guide member so as to be fed by the semicircular roller.

In such an apparatus, however, there is a problem in that if the cassette is not closed by the cover when a sheet is manually fed, both the manually inserted sheet and a sheet from the cassette are simultaneously fed by the semicircular roller, causing jamming of sheets in the conveying system and making it impossible to carry out picture transfer effectively.

SUMMARY OF THE INVENTION

It is therefore an object of the present invention to solve the foregoing problems. It is specific object of the invention to provide a sheet feeding apparatus in which sheets cannot be doubly fed in case of either automatic sheet feeding or manual sheet feeding, and in which both automatic and manual sheet feeding can be carried out with a simple structure.

In order to attain the above objects of the present invention, a sheet feeding apparatus is provided comprising: a sheet accommodating cassette, a semicircular roller disposed above the cassette for feeding sheets from the cassette to conveying rollers, a manually inserted sheet tray for guiding manually inserted sheets to the conveying rollers under the semicircular roller, a manually inserted sheet detecting sensor provided upstream of the conveying rollers, and control means for driving the conveying rollers while the semicircular rollers are in a stopped state in response to a detection signal from the sensor.

That is, the semicircular roller is actuated to operate only when a sheet from the cassette is to be fed, while in a manual insertion/feeding mode, the manually inserted sheet is guided to the conveying rollers so as to be conveyed thereby. In this arrangement no sheet from the cassette can be fed together with a manually inserted sheet.

The apparatus according to the present invention may be applied to any picture recording apparatus in which a sheet is fed so that a picture is formed on the sheet. A suitable picture recording apparatus is disclosed, for example, in commonly assigned Japanese Unexamined Patent Publication No. 62-147461. In this apparatus, a photosensitive material is applied to a support, and a picture formed on the photosensitive material by an image-exposure purposes is fixed and then transferred to a picture-receiving sheet by a pressure transfer process. An example of such an arrangement is disclosed, for example, in commonly assigned Japanese Unexamined Patent Publication No. 61-278849. As disclosed therein, after thermal development, a color picture forming material is transferred to a picture-receiving material having a picture-receiving layer to thereby obtain a picture on the picture-receiving material. In the photosensitive material, at least a photosensitive silver halide, a reducing agent, a polymerizing compound, and a color picture forming material are applied onto a support, with at least the polymerizing compound and the color picture forming material being microcapsulated.

DESCRIPTION OF THE PREFERRED EMBODIMENTS

Referring to the accompanying drawings, preferred embodiments of the present invention will be described.

Figure 1:
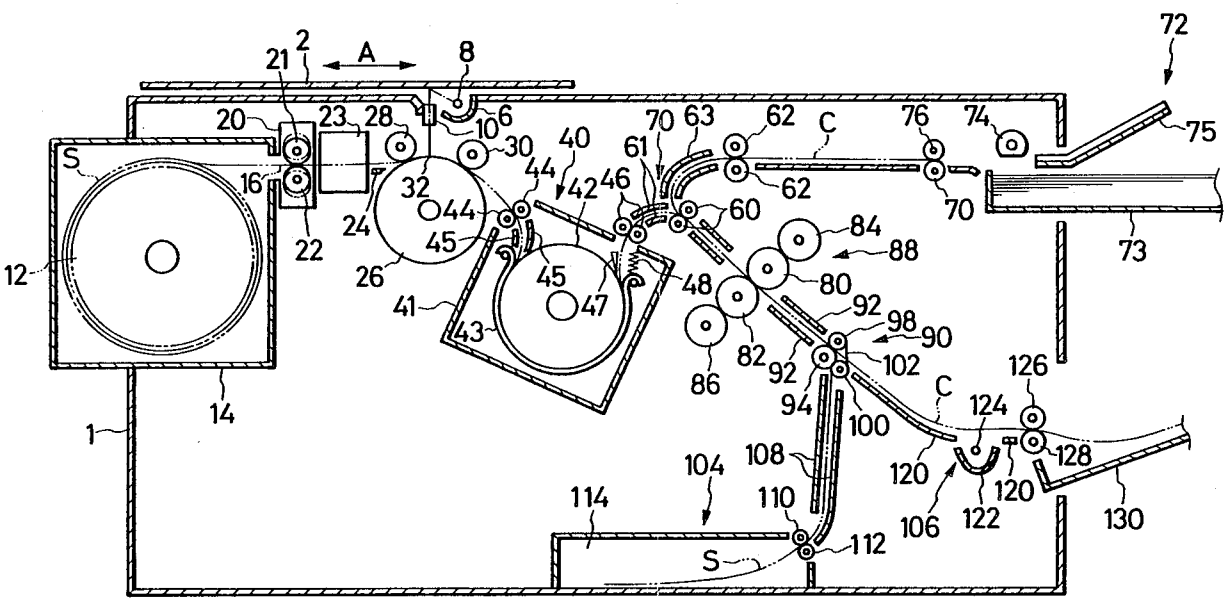
FIG. 1 is a sectional view showing an picture recording apparatus employing a preferred embodiment of a picture-receiving sheet feeding apparatus according to the present invention.

FIG. 1 is a sectional view showing a picture recording apparatus of the present invention.

In the picture recording apparatus, a glass plate 2 for supporting an original is provided at the upper surface of a housing 1, mounted so as to slidably reciprocate in the direction of an arrow A in FIG. 1. That is, the glass plate 2 (with an original placed upside down thereon) reciprocates in the direction of the arrow A.

Below the glass plate 2 there are provided a lamp 8 and a mirror 6 for irradiating the original and a fiber lens array 10 for forming an image of the original on a sensitive material S placed at a predetermined position.

A sensitive material cartridge 14 accommodating a roll 12 of pressure-sensitive and photosensitive (hereinafter abbreviated to merely "sensitive") material S wound thereon is removably attached at a side portion of the housing 1. A pair of draw-out rollers 21 and 22, housed in a magazine connection dark box 20, are provided at the outlet 16 of the sensitive material S from a sensitive material cartridge 14, with which the sensitive material S wound on the roll 12 can be drawn through a predetermined length or drawn back if necessary.

When the forward end of the sensitive material S reaches the draw-out rollers 21 and 22, the rollers 21 and 22 are moved apart from each other to positions as shown by phantom lines in FIG. 1 to thereby facilitate the advance of the sensitive material S. A cutter unit 23 for cutting the sensitive material S and a guide plate 24 are provided in front of the magazine connection dark box 20. (Hereinafter, the term "front" is used to indicate the downstream direction with respect to the direction of advancement of the sensitive material or the like.)

An exposed sensitive material supporting roller 26 and a pair of nip rollers 28 and 30 pressed against the supporting roller 26 are provided in front of the guide plate 24. The sensitive material S guided by the guide plate 24 is held in close contact with the supporting roller 26 by the nip rollers 28 and 30, and exposed to light carrying the image of the original conveyed through the fiber lens array 10 at a position 32 between the sensitive material nip rollers 28 and 30.

A thermal developing device 40 for thermally developing the exposed sensitive material S is provided in front of the supporting roller 26. The thermal developing device 40 is provided with an adiabatic developing housing 41, a conveying drum 42 disposed inside the developing housing 41 for carrying and conveying the sensitive material S, and a heating plate 43 urged by a spring 48 against the outer circumference of the conveying drum 42 through about 240°. The thermal developing device 40 carries out thermal development while conveying the sensitive material S sandwiched between the conveying drum 42 and the heating plate 43. The thermal developing device 40 is further provided with a pair of conveying rollers 44 and guide members 45 for guiding the sensitive material S to the conveying drum 42, and a peel-off pawl 47 for peeling off the sensitive material S from the conveying drum 42 and for guiding the sensitive material S to a contact portion of conveying rollers 46.

A device 70 for overlaying a sheet of sensitive material on picture-receiving sheet is provided in front of the conveying rollers 46. The device 70 is constituted by a pair of pressing rollers 60, guide members 61 for guiding the sensitive material S conveyed by the conveying rollers 46 to a contact portion of the pressing rollers 60, and guide members 63 for guiding the sheet C fed from sheet feeding device 72 and conveyed by conveying rollers 62 to a contact portion of the pressing rollers 60.

The feeding device 72 is constituted by a picture-receiving sheet cassette 73 mounted at a side portion and accommodating picture-receiving sheets C, a sheet draw-out roller 74 for feeding the uppermost sheet C from the cassette 73 to the conveying rollers 62, a guide member 75 for guiding a manually inserted sheet C, and conveying rollers 76 for conveying a sheet C fed thereto.

A transfer device having a pair of pressure nip rollers 80 and 82 and backup rollers 84 and 86 for axially equalizing the pressure of the pressure nip rollers 80 and 82 is provided in front of the device 70. The pressure nip rollers 80 and 82 are pressed against each other with a pressure of about 500 kg/cm$^2$.

A peel-off device 90 for separating a sensitive material sheet and a picture-receiving sheet from each other is provided in front of the transfer device 88. The peel-off device 90 is constituted by guide members 92, a feed roller 94, and a peel-off belt 102 laid around guide rollers 98 and 100 so as to be urged against a sensitive material sheet S at opposite end positions on the outer circumference of the feed roller 94.

A sensitive material discharge section 104 and a fixing device 106 are provided at positions in front of the device 90. The sensitive material discharge section 104 is constituted by guide members 108, a pair of feed rollers 110 and 112, and a discharge box 114. The spent sensitive material S sent from the peel-off device 90 and guided by the guide members 108 is discharged into the discharge box 114 through the feed rollers 110 and 112.

The fixing device 106 is constituted by a guide member 120, an ultraviolet irradiation lamp 124 with a reflecting member 122, and a pair of feed rollers 126 and 128. A picture-receiving sheet C sent from the peel-off device 90 and guided by the guide member 120 is irradiated with ultraviolet rays for about 5 seconds to thereby carry out fixing.

In front of the fixing device 106, a sheet take-up tray 130 for receiving the sheet C is attached to the housing 1 in such a manner as to project therefrom.

Figure 2:
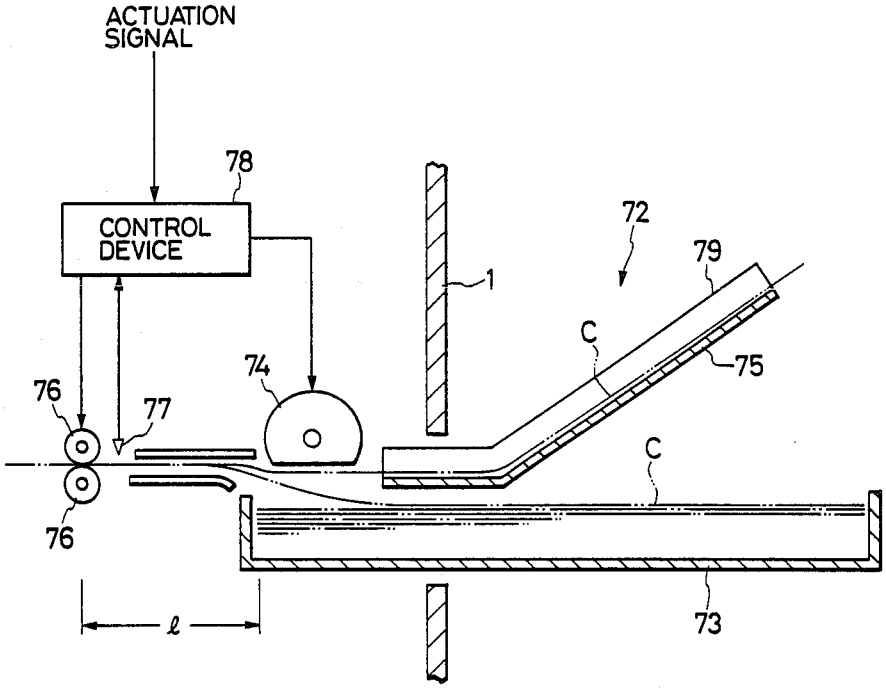
FIG. 2 is a sectional view of the sheet feeding apparatus of FIG. 1.

FIG. 2 is a sectional view showing the sheet feeding device 72.

The cassette 73 accommodating a stack of picture-receiving sheets C is removably provided on the housing 1, and a manual-insertion tray 75 is provided also on the housing 1 above the picture-receiving sheet cassette 73. The semicircular roller 74 for drawing out a sheet C from the cassette 73 is provided in front of the manual-insertion tray 75 and above the cassette 73. A pair of conveying rollers 76 for conveying a sheet C to the device 70 are provided in front of the semicircular roller 74.

In an automatic sheet-feeding mode, the semicircular roller 74 is driven to rotate in synchronism with a picture recording operation signal, the arcuate circumferential surface of the semicircular roller 74 contacts a picture-receiving sheet C, and the sheet C is drawn out by the frictional force between the semicircular roller 74 and the picture-receiving sheet C. The length of the arcuate circumferential surface of the semicircular roller 74 is slightly larger than the distance 1 from the front end of a picture-receiving sheet C in the cassette 73 to the conveying rollers 76 so that the picture-receiving sheet C is overfed by the semicircular roller 74 to a contact portion of the conveying rollers 76 while the rollers 76 are in a stopped state, whereby the sheet C is slightly flexed and the front edge of the sheet C is adjusted to be aligned in the proper direction. After the lapse of predetermined time from the direction of the presence of the sheet C by a sensor 77 provided upstream of the conveying rollers 76, the rollers 76 are driven to convey the sheet C. A control device 78 controls the driving of the semicircular roller 74 and the conveying rollers 76 in response to an actuation signal, and a picture-receiving sheet detection signal from the sensor 77, respectively.

In manually feeding a picture-receiving sheet C, the control device 78 controls the semicircular roller 74 so as to not rotate in response to an actuation signal in the manual inserting/feeding mode. In the manual mode, the operator feeds a sheet C to the conveying rollers 76 along the manual-insertion tray 75 to the region below the semicircular roller 74. The tray 75 is provided with a plate 79 for restricting one side edge of the sheet C so that when the sheet C is manually fed along the restriction plate 79, it is fed in the proper direction. When the sheet C reaches the contact portion of the conveying rollers 76, which are then in the stopped state, the sheet C is over-fed and flexed so that the front edge of the sheet C is adjusted to be aligned in the proper direction. After the lapse of a predetermined time from the direction of the arrival of the sheet C by the sensor 77, the conveying rollers 76 are made to rotate by the control device 78.

After feeding a sheet C from the cassette 73, the semicircular roller 74 is stopped with its flat surface facing downward. The manual-insertion tray 75 mounted so as to guide a sheet C below the flat surface of the semicircular roller 74. When a sheet C is manually fed, the semicircular roller 74 is controlled by the actuation signal to said controller so as not to rotate. Hence, a sheet C from the cassette 73 will not be fed together with a manually inserted sheet C, even if no cover or the like is provided on the cassette 73.

A description has been made as to an embodiment in which a picture from a thermally developed sensitive material is pressure transferred. However, the present invention is not limited to this arrangement and is applicable to any other sheet feeding apparatus, such as an electrophotographic apparatus. Furthermore, the sheet material used in the present invention is not limited to a paper picture-receiving sheet but may be a picture projection film (a sheet for overhead projector), etc.

According to the present invention, a sheet from a cassette is drawn out by a semicircular roller and conveyed by conveying rollers while, when a sheet is manually fed, the semicircular roller is stopped and the manually inserted sheet is conveyed only by conveying rollers. Thus, when a sheet is fed manually, no sheet from the cassette will be drawn out by the semicircular roller and thus no sheet is conveyed together with the manually inserted sheet. Accordingly, no sheet jamming occurs in a succeeding conveying system. Further, it is possible to carry out automatic sheet feeding as well as manual sheet-feeding with a simple structure.

What is claimed is:

1. A sheet feeding apparatus comprising: a pair of conveying rollers in an automatic sheet feeding mode; a sheet accommodating cassette; a semicircular roller disposed above said cassette for feeding sheets automatically from said cassette to said conveying rollers in an automatic sheet feeding mode; a manually inserted sheet tray for guiding a manually inserted sheet to said conveying rollers along a path under said semicircular roller in a manual sheet feeding mode; a sheet detecting sensor provided upstream of said conveying rollers for sensing either a manually inserted sheet or a sheet fed from said cassette by said semicircular roller towards said conveying rollers; and control means operatively connected to said semicircular roller, said sheet detecting sensor and said conveying rollers and responsive to an actuation signal in the manual sheet feeding mode for stopping said semicircular roller and responsive to receiving a sheet detection signal from said sensor indicating either the presence of a manually fed sheet or a sheet fed by said semicircular roller from said cassette for driving, after a time delay, said conveying rollers to further feed said sheets in either manual or automatic sheet feeding modes.

2. The sheet feeding apparatus of claim 1, wherein said semicircular roller is always stopped after the feeding of each sheet with a flat part thereof directed downward.

3. The sheet feeding apparatus of claim 1, wherein said manually inserted sheet tray comprises a restriction plate along one edge portion thereof.

* * * * *